United States Patent [19]

Hirata et al.

[11] Patent Number: 4,794,363

[45] Date of Patent: Dec. 27, 1988

[54] THERMOSTAT TYPE OPERATING TEMPERATURE SETTING APPARATUS UTILIZING CONICAL COMPRESSION SPRING

[75] Inventors: Shigeru Hirata; Hideyuki Yajima; Koichi Takahashi, all of Tokorozawa, Japan

[73] Assignee: Kabushiki Kaisha Saginomiya Seisakusho, Tokyo, Japan

[21] Appl. No.: 105,032

[22] Filed: Oct. 6, 1987

[30] Foreign Application Priority Data

Oct. 13, 1986 [JP] Japan ..... 61-241472

[51] Int. Cl.[4] ..... H01H 37/36; H01H 37/12

[52] U.S. Cl. ..... 337/314; 200/835; 337/319

[58] Field of Search ..... 337/314, 312, 313, 317, 337/318, 319, 320, 321, 306; 200/83 WM, 83 S, 83 SA

[56] References Cited

FOREIGN PATENT DOCUMENTS 58-57048 4/1983 Japan .

*Primary Examiner*—H. Broome

*Attorney, Agent, or Firm*—Lowe, Price, LeBlanc, Becker & Shur

[57] ABSTRACT

In a thermostat type operating temperature setting apparatus, a slider is employed to preset the operating temperatures of electric appliances by sliding the slider along a long sliding path. The operating temperature setting apparatus includes a frame, a converter for converting temperature changes into pressure variations, a thermostat switching member for selectively changing bistable switching positions in response to the pressure variations, a rod for adjusting the operating temperature, a tension spring coupled between the adjusting rod and the switching member, for biasing the adjusting rod in a first direction, a slider, and a cam lever pivotably journaled to a fulcrum fixed on the frame and connected to the adjusting rod, for being slidably in touch with the slider. The setting apparatus further includes a conical compression spring mounted on the adjusting rod, for biasing the adjusting rod in a second direction opposite to the first direction. Accordingly, the slider is slidable on the long sliding path with the substantially same sliding force over the long sliding path.

10 Claims, 3 Drawing Sheets

THERMOSTAT TYPE OPERATING TEMPERATURE SETTING APPARATUS UTILIZING CONICAL COMPRESSION SPRING

BACKGROUND OF THE INVENTION

The present invention relates to a thermostat type operating temperature setting apparatus employed in air conditioning apparatus, heating apparatus, etc.

Various modes of the thermostat type operating temperature setting apparatus have been recently developed for freely controlling the operating temperatures of electric appliances. A sliding type thermostat temperature controller is described, as one of these thermostat type operating temperature setting apparatuses, in, for instance, Japanese unexamined (KOKAI) utility model application No. 58-57048 (1983). Such a sliding type thermostat temperature controller is operated in the following manner. The operating-temperature setting slider slidable along a straight line is engaged with the cam plate under an influence of the tension spring. Tension of the tension spring is adjusted against the movement of the pressure responsive member such as a bellows to preset the operating temperature of the thermostat type temperature controller. Since the cam plate has a relatively long cam stroke in engagement with the slider, smooth sliding operation can be achieved.

The above-described conventional thermostat temperature controller has, however, the following drawbacks.

While the slider approaches the fulcrum of the cam plate, the sliding load thereof, or sliding force capable of sliding the slider rises abruptly. In other words, the sliding load is small when the slider is positioned remote from the fulcrum of the cam plate. Such unbalance sliding load characteristics are particularly emphasized if the cam stroke is relatively long due to the principle of the lever. In the prior art controller, the compression spring exerting the counter torque against the above tension is employed to linearly exert the compensating spring force, whereas the sliding load characteristics are nonlinear as described above. As a result, it is practically difficult to linearize the sliding load characteristics over the entire cam stroke, or entire sliding path. That is to say, the sliding load scale of the slider cannot be uniform over the entire sliding path.

An object of the present invention is, therefore, to eliminate the above-described conventional drawbacks, and to provide a thermostat type operating temperature setting apparatus in which the nonlinear sliding load characteristics of the slider can be linearized by employing a conical compression spring exerting compensating torque with respect to the sliding load characteristics.

The advantage of employing the conical compression spring in cooperation with the tension spring is that the slider can be smoothly slid at any position on the longer sliding path by the substantially equal sliding torque.

SUMMARY OF THE INVENTION

The above and other objects of the present invention are realized by providing an operating temperature setting apparatus comprising:

a frame;

a converter for converting temperature changes into pressure variations;

a switching device for selectively changing bistable switching positions in response to the pressure variations of the converter;

an adjusting device for adjusting the operating temperature of the converter;

a first spring coupled between the operating temperature adjusting device and the switching device, for biasing the adjusting device in a first direction;

a slider capable of sliding along a long sliding path;

a cam lever pivotably journaled to a fulcrum member fixed on the frame and connected to the adjusting device, for being slidably in touch with the slider; and, a second spring in the form of a conical spring mounted on the adjusting device, for biasing the adjusting device in a second direction opposite to the first direction of the first spring, whereby the slider is slidable on the long sliding path with substantially the same sliding force over the long sliding path.

BRIEF DESCRIPTION OF THE DRAWINGS

The present invention will be more readily understood on reading the following description with reference to the accompanying drawings, in which.

DETAILED DESCRIPTION OF THE DRAWINGS

Construction of Thermostat Type Operating Temperature Setting Apparatus

Figure 1:
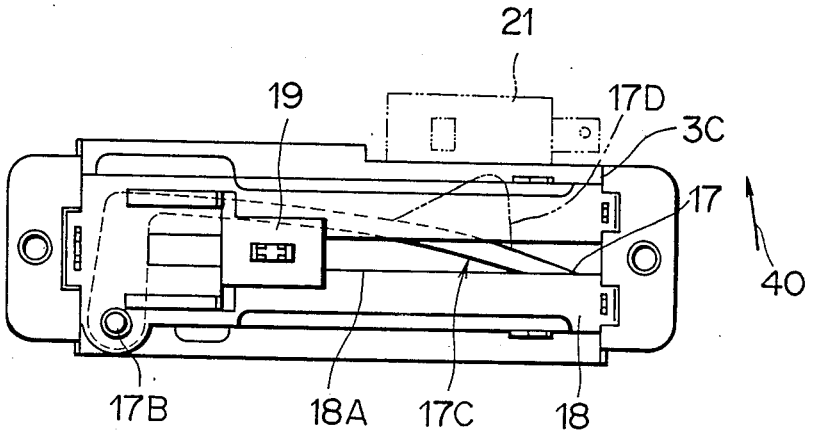
FIG. 1 is a plan view showing a thermostat type operating temperature setting apparatus according to one preferred embodiment of the invention.
Figure 2:
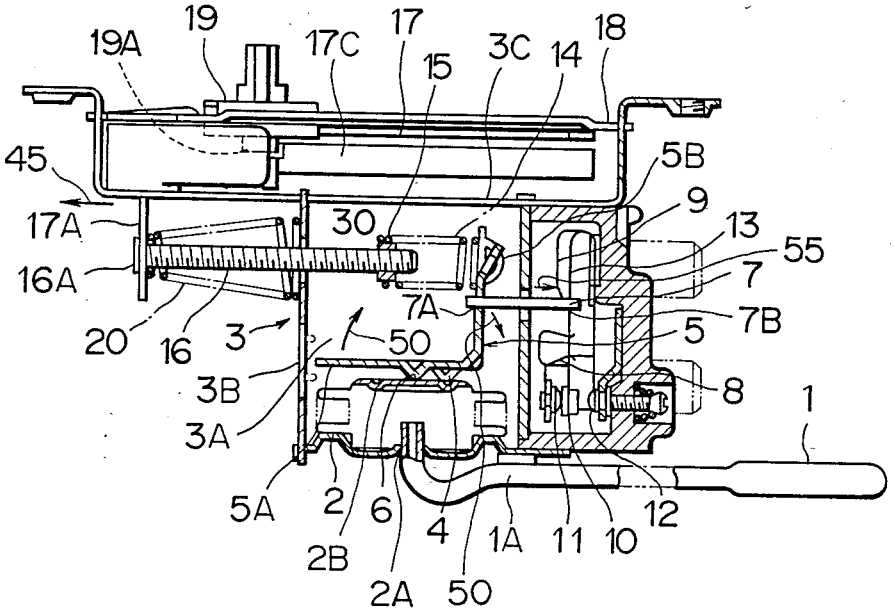
FIG. 2 is a cross-sectional view of the setting apparatus illustrated in FIG. 1.
Figure 3:
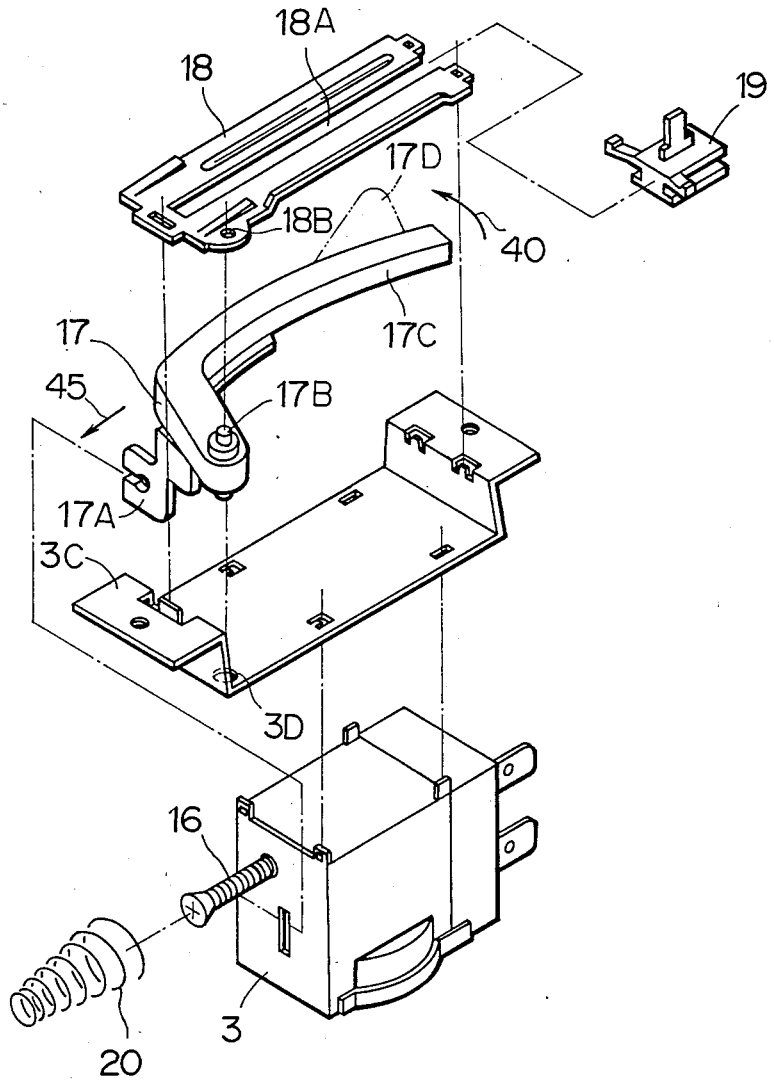
FIG. 3 is an exploded perspective view of the setting apparatus illustrated in FIG. 1; and, FIG. 4 is a graphic representation showing the relationship between the sliding force and the sliding position.

Referring now to FIGS. 1 to 3, a construction of a thermostat type operating temperature setting apparatus according to one preferred embodiment will be described.

In FIG. 2, a temperature sensing bulb 1 filled with a temperature sensing gas such as Freon gas (tradename) is mechanically coupled via a capillary tube 1A to a base portion 2A of a bellows 2 functioning as a pressure responsive member. A free end portion 2B of the bellows 2 abuts on a pivot 6 provided at a horizontal portion 5A of an L-shaped actuating plate 5. The actuating plate 5 is pivotably rotated around a fulcrum 4 which is positioned with respect to a hole (not shown) formed on both side walls 3A of a frame 3. A vertical portion 5B of the actuating plate 5 supports one end 7A of an actuating rod 7 centrally, add the other end 7B of the actuating rod 7 is connected to a switching plate 9 having a so-called "snap action spring 8" having bistable rest positions. A contact plate 13 which is mechanically driven through the snap action spring 8 by the switching plate 9 is formed with a movable contact 10 at its free end portion, and thus, the movable contact 10 is selectively switched between a fixed contact 11 and a supporting portion 12 of the switching plate 9 opposite to the fixed contact 11.

The vertical portion 5B of the L-shaped actuating plate 5 is engaged with one end of a tension spring 14. The tension spring 14 is employed as a temperature adjusiing main spring, which exerts tension spring force against the expansion force of the bellows 2. The other end of the main tension spring 14 is coupled to a temperature adjusting threaded rod 16 via a nut 15. The threaded rod 16 projects externally outwardly from the frame 3 via a through hole 30 formed on the front wall 3B of the frame 3.

A head 16A of the threaded rod 16 remote from the main tension spring 14 is held in engagement with a connecting member 17A. The connecting member 17A is vertically hung down from a cam plate 17 arranged on a top plate 3C of the frame 3, as viewed in FIG. 2.

Over the top plate 3C, a slider supporting plate 18 is positioned in parallel therewith and spaced therefrom with a predetermined clearance. The slider supporting plate 18 is formed with a straight slide slot 18A in a direction parallel to the longitudinal direction of the threaded rod 16 as illustrated in FIGS. 1 and 3.

The cam plate 17 is rotatably supported between the top plate 3C and the slider supporting plate 18 by a fulcrum pin 17B formed on the base portion of the cam plate 17, in cooperation with through holes 18B and 3D of the slider supporting plate 18 and the frame 3, respectively. A slight arc-shaped cam surface 17C of the cam plate 17 is arranged so as to intersect the slide slot 18A at a very small acute angle. It should be noted that the arc-shaped cam surface 17C defines the cam stroke in cooperation with a slider 19 slidable along the straight slide slot 18A, and the entire length of this cam stroke is rather longer than that of the conventional cam stroke, as previously described. A circular projection 19A is formed on the slider 19 (see FIG. 2) and slid on the cam surface 17C. When the projection 19A of the slider 19 is slid from a release position near the fulcrum pin 17B toward a position remote therefrom, it enables the cam plate 17 to be rotated about the fulcrum pin 17B in the counter-clockwise direction indicated by an arrow 40. As a result, the connecting member 17A is moved in the direction indicated by an arrow 45 against tension of the main tension spring 14 via the threaded rod 16.

A conical compression spring 20 is arranged between the connecting member 17A and the front wall 3B of the rrame 3, and wound on the temperature adjusting threaded rod 16. The smallest diameter of the conical compression spring is designed to be substantially equal to the diameter of the conventional cylindrical diameter in the preferred embodiment. This is because the length of the wound compression coil is made long as permitted as possible to mitigate the sliding load difference at the sliding positions of the slider 19. Since the maximum length of the compression spring into which the threaded rod 16 is inserted is limited to a predetermined short length due to its compactness, the conical compression spring is employed in the preferred embodiment under the above-defined conditions.

Referring back to FIG. 2, the switching contacts 10 to 12 of the switching plate 9 are used to turn on and off, for instance, a compressor of an air conditioner (not shown in detail).

A microswitch 21 may be positioned on one side surface of the faame 3 and near the free end portion of the cam plate 17, as illustrated in FIG. 1, if required. When the slider 19 is slid in the right direction, a projection 17D which may be also formed on a side wall opposite to the cam surface 17C of the cam plate 17 turns off the microswitch 21. Thus, a power source of a main appliance such a a compressor of a refrigerator (not shown in detail) can be turned off. Moreover, the thermostat (i.e., the switching contacts 10 to 12) may also serve as this power switch.

Operation of Temperature Setting Apparatus

Referring to the construction of the thermostat type operating temperature setting apparatus as illustrated in FIGS. 1 to 3, the temperature setting operation will now be described in detail.

It should be noted that the slider 19 has been preset on a given sliding position as illustrated in FIG. 2 (i.e., the leftmost sliding position adjoining the fulcrum pin 17B).

In FIG. 2, when the temperature sensing cylinder 1 has sensed a temperature rise, the bellows 2 commences to expand, and the free end portion 2B thereof pushes up the horizontal portion 5A of the L-shaped actuating plate 5.

Then, the L-shaped actuating plate 5 is rotated in the clockwise direction, as indicated by an arrow 50, around another fulcrum 4 against the spring force exerted by the tension spring 14. As a result, the actuating rod 7 is moved in the right direction as represented by an arrow 55, so that the actuating plate 5 moves the switching plate 9 through the actuating rod 7 until the movable contact 10 is touched to the fixed contact 11 as illustrated in FIG. 2 under the influence of the snap action spring 8. Then, it turns on, for example, an actuating circuit of a refrigerating apparatus (not shown).

The above-described change over point of the movable contact 10 is controlled by selecting the setting position of the slider 19 (will be described later).

Under the conditions as shown in FIG. 2, when the ambient temperature of the temperature sensing cylinder 1 starts to decrease, the bellows 2 contracts and thereafter the movable contact 10 remotes from the fixed contact 11 when the deformation of the switching plate 9 exceeds over the dead point of the snap action spring 9, thereby turning off the actuating circuit of the refrigerating apparatus. Thus, the switching operation of these contacts 10 to 12, the actuating rod 7 and the snap action spring 9 corresponds to the thermostat operation.

Sliding Operation of Slider

Sliding operation of the slider 19 will now be described more in detail so as to preset the operating temperature for the thermostat.

When the slider 19 is slid along the long sliding slot 18A in the right direction shown in FIGS. 1 and 2 (i.e., toward the sliding position remote from the fulcrum pin 17B), the projection 19A formed on the slider 19 is slid on the cam surface 17C so that the cam plate 17 is rotated in the direction indicated by the arrow 40 around the fulcrum pin 17B (i.e., the counterclockwise direction in FIG. 1), because the sliding operation of the slider 19 is defined by the slot 18A of the slider supporting plate 18. Accordingly, the connecting member 17A is moved in the direction represented by an arrow 45, i.e., in the left direction viewed in FIG. 2, and in turn, the threaded rod 16 is also moved in the left direction. Consequently, the tension of the tension spring 14 increases.

While the slider 1 comes closer to the rightmost sliding position, viewed in FIGS. 1 and 2, the tension of the tension spring 14 becomes more increased. However, the sliding load of the slider 19, i.e., the sliding force "F" capable of sliding the slider 19 becomes relatively small, as compared with the sliding force near the fulcrum pin 17B, because of the principle of the lever. As is apparent from FIG. 2, the slider 19 is slid in the right direction against the tension "$F_1$" of the tension spring 14.

The relationship between the sliding force "F" and the tension "$F_1$" is expressed by the following equation.

$$F = l_1/l_0 \times F_1$$

where "$l_1$" denotes the distance between the fulcrum pin 17B and the axis of the threaded rod 16, and "$l_0$" denotes the distance between the fulcrum pin 17B and the contact point made between the projection 19A of the regulating slider 19 and the cam surface 17C of the cam plate 17.

In the preferred embodiment, since the sliding slot 18A intersects with the cam surface 17C at the very small acute angle, the rotating amount of the cam plate 17 is smaller than the sliding amount of the slider 19. This implies that the sliding force "F" capable of sliding the slider 19 changes, depending upon the sliding positions on the long sliding slot 18A. Such a sliding force characteristic is furthermore emphasized if the length of the sliding stroke of the cam surface 17C becomes more long. Accordingly, if the slider 19 located near the fulcrum pin 17B is slid toward the rightmost sliding position, the very strong sliding force is required, as compared with the case where the slider 19 is located at the rightmost sliding position.

To avoid such a conventional drawback, the feature of the present invention is to simply employ the conical compression spring 20 wound on the temperature adjusting threaded rod 16 and positioned between the connecting member 17A and the side wall 3A, while the connecting member 17A is biased in the direction indicated by the arrow 45 by the conical compression spring 20 against the tension of the tension spring 14. The present invention is achieved by the following recognition that the compression spring force exerted by such a conical compression spring is rapidly increased, when being compressed. In cooperation with the tension of the main tension spring 14 for controlling the operating temperature, the employment of the conical compression spring 20 enables the sliding force of the slider 19 to be substantially equal at any sliding position along the longer sliding stroke. In other words, the sliding load characteristics of the slider 19 is varied, or linearized over the longer sliding path, so that the slider 19 can be smoothly slid at any sliding position with substantially equal and small sliding force.

Relationship Between Sliding Position and Sliding Force

Figure 4:
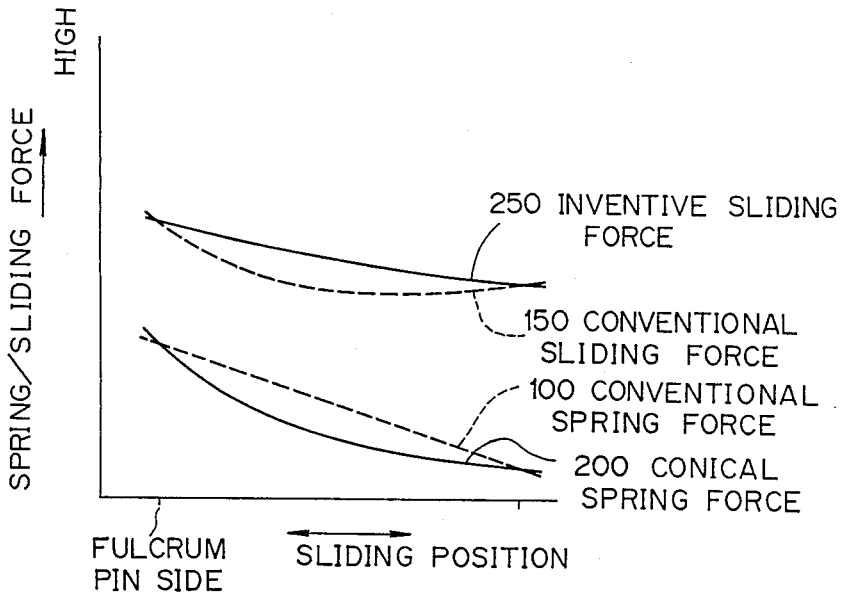

FIG. 4 is a graphic representation showing the relationship between the sliding positions of the sliders and the sliding force for the slider at the corresponding sliding position.

First, reference numeral 100 denotes the spring force exerted by the conventional compression spring, whereas reference numeral 200 indicates the spring force produced by the conical compression spring 20 according to the invention. As is easily seen from these characteristic curves, the conventional compression spring force changes linearly over the entire sliding position, whereas the conical compression spring force varies nonlinearly. Precisely speaking, the spring force exerted near the fulcrum pin 17B is considerably higher than that far from the fulcrum pin 17B, and the force changing rate near the fulcrum pin is greater than that remote from it.

Under the above-described spring force conditions, there are a great difference in the resultant sliding force of the slider as represented by reference numerals 150 and 250, respectively. When employing the conventional compression spring, the resultant sliding force for the slider (not shown) varies nonlinearly over the entire sliding position. As a result, the conventional slider cannot be slid over the longer sliding path by the substantially uniform sliding force.

To the contrary, when employing the conical compression spring 20 according to the invention, the resultant sliding force for the slider 19 changes linearly over the entire sliding position. That is to say, the slider 19 can be smoothly slid over the entire sliding position by the substantially uniform sliding force, in particular, which is emphasized when the longer sliding path, or slot is employed.

As previously described in detail, sliding the siider along the longer stroke of the cam lever enables the operating temperature of the electric appliance to be preset in the thermostat type operating temperature setting apparatus according to the invention by smoothly sliding the slider with the substantially uniform sliding force. That is to say, the operating temperature adjusting rod is move by utilizing the principle of the cam lever. Since the conical compression spring is mounted on the adjusting rod to generate the compensation spring force for the unbalance sliding force, the slider can be smoothly slid over the longer sliding path with substantially same sliding force.

What is claimed is:

1. An operating temperature setting apparatus comprising:

a frame;

means for converting temperature changes into pressure variations;

switching means for selectively changing bistable switching positions in response to the pressure variations of the converting means;

means for adjusting the operating temperature of the converting means;

first spring means including a tension spring coupled between the operating temperature adjusting means and the switching means, for biasing the adjusting means in a first direction;

sliding means capable of sliding along a sliding path;

cam lever means pivotably journaled to a fulcrum member fixed on the frame and connected to the adjusting means, for being slidably in touch with the sliding means; and, second spring means including a coincal compression spring mounted on the adjusting means, for biasing the adjusting means in a second direction opposite to the direction of the first spring means such that the sliding means is slidable on the sliding path with substantially the same sliding force over the sliding path.

2. An operating temperature setting apparatus as claimed in claim 1, wherein one end portion of said tension spring is connected via a nut to one end portion of said operating temperature adjusting means, and the other end portion of said tension spring is connected to said switching means.

3. An operating temperature setting apparatus as claimed in claim 1, wherein said tension spring has a substantially same first diameter throughout its length, and said conical compression spring has a second diameter and a third diameter, said second diameter being substantially equal to said first diameter and said third diameter being greater than said second diameter.

4. An operating temperature setting apparatus as claimed in claim 1, wherein said operating temperature adjusting means is a threaded rod.

5. An operating temperature setting apparatus as claimed in claim 1, wherein said converting means includes:

a temperature sensitive cylinder filled with a temperature sensitive gas and having a capillary tube; and a bellows, one end portion of which is fixed to said frame and the other end portion of which is freely movable in response to the pressure variations.

6. An operating temperature setting apparatus as claimed in claim 1, wherein said switching means includes:

an L-shaped actuating plate having a second fulcrum abutting on said converting means, one end portion of which is connected to said first spring means, whereby said L-shaped actuating plate is rotated in a first rotating direction around the second fulcrum in response to the pressure variations; and

7. An operating temperature setting apparatus as claimed in claim 6, wherein said switching means functions as a thermostat switch; and wherein the other end portion of said L-shaped actuating plate receives the tension of said tension spring to be rotated around said second fulcrum in a second rotating direction opposite to said first rotating direction.

8. An operating temperature setting apparatus as claimed in claim 1, wherein said cam lever means includes an arc-shaped cam surface and said sliding path is formed by an elongated slot through which said sliding means is slid, said arc-shaped cam surface being intersected with a longitudinal axis of said elongated slot at a small acute angle.

9. An operating temperature setting apparatus as claimed in claim 8, wherein said sliding means includes a circular projection capable of sliding on said arc-shaped cam surface of the cam lever.

10. An operating temperature setting apparatus comprising:

a frame;

means for converting temperature changes into pressure variations;

switching means for selectively changing bistable switching positions in response to the pressure variations of the converting means;

means for adjusting the operating temperature of the converting means;

first spring means coupled between the operating temperature adjusting means and the switching means, for biasing the adjusting means in a first direction;

sliding means capable of sliding along a sliding path;

cam lever means pivotably journaled to a fulcrum member fixed on the frame and connected to the adjusting means, for being slidably in touch with the sliding means; and second spring means mounted on the adjusting means, for biasing the adjusting means in a second direction opposite to the first direction of the first spring means, wherein said cam lever means includes an arc-shaped cam surface and said sliding path is formed by an elongated slot through which said sliding means is slid, said arc-shaped cam surface being intersected with a longitudinal axis of said elongated slot at a small acute angle and wherein said cam lever means further includes a switching projection formed opposite to said arc-shaped cam surface, and a microswitch having an actuator is mounted on said frame, said actuator of the microswitch being depressed by said switching projection to switch said microswitch.

* * * * *